United States Patent [19]

Butler et al.

[11] Patent Number: 4,910,687

[45] Date of Patent: Mar. 20, 1990

[54] BIT GATING FOR EFFICIENT USE OF RAMS IN VARIABLE PLANE DISPLAYS

[75] Inventors: Nicholas D. Butler, Romsey; Brian C. Homewood, Winchester, both of United Kingdom; Steven P. Larky, New York, N.Y.

[73] Assignee: International Business Machines Corporation, Armonk, N.Y.

[21] Appl. No.: 116,104

[22] Filed: Nov. 3, 1987

[51] Int. Cl.[4] ..... G09G 1/16

[52] U.S. Cl. ..... 364/521; 340/799; 340/800; 364/900

[58] Field of Search ..... 364/518, 521, 900 MS File; 340/750, 798, 799, 800

[56] References Cited

U.S. PATENT DOCUMENTS

| | | | |
|---|---|---|---|
| 4,674,064 | 6/1987 | Vaughn | 364/900 |
| 4,747,081 | 5/1988 | Heilveil et al. | 365/240 X |
| 4,777,481 | 10/1988 | Craver | 340/799 X |
| 4,791,580 | 12/1988 | Sherrill et al. | 340/799 X |
| 4,800,380 | 1/1989 | Lowenthal et al. | 340/799 X |

*Primary Examiner*—Gary V. Harkcom
*Assistant Examiner*—H. R. Herndon
*Attorney, Agent, or Firm*—Jack M. Arnold

[57] ABSTRACT

Apparatus for serializing $2^M$ parallel outputs of an all points addressable memory into successive data groups, with each data group corresponding to a respective value for a pixel in an image, wherein the bit-length of the pixel value is selectable. The apparatus includes a gate circuit having $2^M$ parallel input junctions connected to the outputs of the memory and $2^N$ output junctions. The gate circuit selectively converts each set of $2^M$ parallel inputs at the input junctions in to $2^{M-n}$ successive data groups, with each group having a bit-length of $2^n$ bits. Each such group is transmitted to $2^n$ of the $2^N$ output junctions. A communication element conveys to the gate circuit a signal which controls the bit-length $2^n$ of the data groups, wherein n is an integer $1 \leqq n \leqq N \leqq M$.

8 Claims, 6 Drawing Sheets

302
301
534
D-TYPE FLIP FLOP CLK
SB31
VD31
VD23
VD27
VD29
VD30
362
4:1 MUX
2:1 MUX S
532
SB30
432
VD15
VD23
VD27
VD29
360
530
SB29
430
308
VD24
VD12
VD6
VD3
378
478
SB3
VRAMS
VD16
VD8
VD4
VD2
306
476
SB2
376
VD8
VD4
VD2
VD1
SELECT 0
SELECT 1
304
474
SB1
374
VD0
470
SB0
370
500
COUNTER
CLOCK
VIDEO 7 (SB28)
VIDEO 6 (SB6)
VIDEO 5 (SB20
VIDEO 4 (SB4)
VIDEO 3 (SB24)
VIDEO 2 (SB8)
VIDEO 1 (SB16)
VIDEO 0 (SB0)

BIT GATING FOR EFFICIENT USE OF RAMS IN VARIABLE PLANE DISPLAYS

BACKGROUND OF THE INVENTION

I. Field of the Invention

The present invention relates to apparatus for communicating pixel data from Random Access Memory (RAM) memory to a display where the number of bits/-pixel may be varied.

II. Description of the Problem

In displaying an image, it is well-known to scan a beam across a Cathode Ray Tube (CRT) screen one picture element after another one row after another. For each picture element (or pixel), there is a corresponding brightness or chrominance.

In an all points addressable (APA) display, the brightness or chrominance is independently programmable. That is, for each pixel, a value corresponding to brightness or chrominance is stored in an APA memory. Any value in the memory may be changed at any time in a conventional manner.

As a scanning beam moves along a display screen, the value corresponding to one pixel after another in succession is retrieved and used to affect the magnitude of the scanning beam. For example, when the beam is at the upper left pixel of the screen, a value in memory which corresponds to the upper left pixel is retrieved, and processed in some way, with a resulting value being applied to the beam as it is positioned over the upper left pixel. As the beam moves to the second pixel in the top row, a value in memory corresponding to that pixel is retrieved from memory and processed, with the resulting value being applied to the beam. The value stored for each successive pixel is sequentially retrieved and processed, so that successive resulting values are applied to the beam to produce the image.

The pixel values are communicated serially to the display in the order the beam scans. Starting in the upper left corner, the beam moves horizontally across the video display. At the end of the scanline, the beam is blanked and reset to the beginning of the next line. This continues until all scanlines are drawn. Using current technology, 1024 pixels across and 1024 scanlines are drawn, for a total of 1,048,576 pixels. As is known in the art, the image may be formed of interleaved fields if desired.

Generally, the image must be refreshed periodically to continuously display an image. In a typical system, the display must be refreshed 60 times per second. That is, every pixel value must be read out of the memory array and sent to a CRT controller—which controls the amplitude of the electron beam—60 times per second.

In order to refresh the entire screen in 1/60th of a second, the pixels are drawn at a rate in excess of 100 Megahertz. The memory array must be capable of providing a new pixel every 10 nanoseconds.

To communicate the pixel values fast enough to satisfy the image refresh requirements, video random access memories (VRAMs) are employed. Like conventional dynamic RAMs (DRAMs), a VRAM includes a random access port. The random access port is used to identify a specific location in memory to which data is to be read or written. For example, a first 9-bit word entering the random access port may identify the horizontal position of a location, while a second 9-bit word identifies the vertical position of the location. The two words form the address for a location in memory.

The VRAM also includes a second, serial port. The purpose of the serial port is to convey data words to the CRT controller for one pixel after another. The serial port has a plurality of outputs for conveying out memory data words of some length.

In the past, a plurality of VRAMs in parallel would provide a collective data word of a bitlength, $2^M$. The collective data word would enter a shift register stage which would split the data word into a fixed sequence of smaller words derived from the collective data word. The shift register stage permitted serial access, the kind of access required for an APA display. Output from the serial port is controlled by an independent clock. Every pulse of the serial clock causes the VRAM to present a next data value as output therefrom.

There is, however, a problem with using simple VRAMs in refreshing a display. The serial port of the conventional VRAM is normally inflexible. That is, the number of bits allocated to each pixel is normally fixed. For example, the memory may be configured so that each pixel has 8 bits of memory allocated thereto. This results in a tremendous waste of memory space if the pixels represent binary (black/white) image data or color or graylevel data requiring less than 8 bits/pixel. For binary data, a 1024×1024 pixel screen would require 128K of memory. However, if 8 bits are allocated to each pixel, a full megabyte of dedicated bitmap memory is required. Defining the memory to have 8 bits/-pixel thus results in 876K of unused memory when the pixels represent binary data. This is illustrated in FIG. 1.

In FIG. 1, eight VRAMs 100 to 114 are shown, each having four outputs. Together the eight VRAMs produce 32 parallel outputs VD0 through VD31. To convert the 32 outputs into successive 8-bit pixel values, eight 4-to-1 shift registers 120 through 134 are illustrated. (It is noted that in the present description the term "through" may be used to indicate a sequence of even-numbered elements where there are no odd-numbered elements therebetween.) The VRAM outputs VD0 through VD31 are shown entering specified inputs to the eight 4-to-1 shift registers 120 through 134. For example, shift register 134 receives as its four inputs: VD0 from VRAM 114; VD8 from VRAM 110; VD16 from VRAM 106; and VD24 from VRAM 102. These four bits are shifted out from shift register 134 in sequence. With each clock pulse, each shift register 120 through 134 is able to shift out a bit; together the eight shift registers can shift out an 8-bit value.

First, a word containing VRAM outputs VD0 through VD7 is conveyed along shift register outputs VIDEO0 through VIDEO7. Then a word containing VRAM outputs VD8 through VD15 is output along VIDEO0 through VIDEO7, and so on. So long as each pixel corresponds to 8-bits, the FIG. 1 structure is adequate. If each pixel is to be represented with a 4-bit word (or 2-bit word or 1-bit word), inefficiency and problems result.

Some problems associated with the FIG. 1 structure are understood with reference to TABLE 1 and TABLE 2. TABLE 1 is a table listing the 32 outputs from the VRAMs (of FIG. 1) and indicating which bit B in which pixel P the output corresponds to in either of four environments: when each pixel has an 8-bit, 4-bit, 2-bit, or 1-bit value.

TABLE 1

| | Bit definitions for different bits/pixel | | | | | | | |
|---|---|---|---|---|---|---|---|---|
| | Bit B in pixel P | | | | | | | |
| Bit number | 8 bits/pixel | | 4 bits/pixel | | 2 bits/pixel | | 1 bit/pixel | |
| 31 | 7 | 0 | 3 | 0 | 1 | 0 | 0 | 0 |
| 30 | 6 | 0 | 2 | 0 | 0 | 0 | 0 | 1 |
| 29 | 5 | 0 | 1 | 0 | 1 | 1 | 0 | 2 |
| 28 | 4 | 0 | 0 | 0 | 0 | 1 | 0 | 3 |
| 27 | 3 | 0 | 3 | 1 | 1 | 2 | 0 | 4 |
| 26 | 2 | 0 | 2 | 1 | 0 | 2 | 0 | 5 |
| 25 | 1 | 0 | 1 | 1 | 1 | 3 | 0 | 6 |
| 24 | 0 | 0 | 0 | 1 | 0 | 3 | 0 | 7 |
| 23 | 7 | 1 | 3 | 2 | 1 | 4 | 0 | 8 |
| 22 | 6 | 1 | 2 | 2 | 0 | 4 | 0 | 9 |
| 21 | 5 | 1 | 1 | 2 | 1 | 5 | 0 | 10 |
| 20 | 4 | 1 | 0 | 2 | 0 | 5 | 0 | 11 |
| 19 | 3 | 1 | 3 | 3 | 1 | 6 | 0 | 12 |
| 18 | 2 | 1 | 2 | 3 | 0 | 6 | 0 | 13 |
| 17 | 1 | 1 | 1 | 3 | 1 | 7 | 0 | 14 |
| 16 | 0 | 1 | 0 | 3 | 0 | 7 | 0 | 15 |
| 15 | 7 | 2 | 3 | 4 | 1 | 8 | 0 | 16 |
| 14 | 6 | 2 | 2 | 4 | 0 | 8 | 0 | 17 |
| 13 | 5 | 2 | 1 | 4 | 1 | 9 | 0 | 18 |
| 12 | 4 | 2 | 0 | 4 | 0 | 9 | 0 | 19 |
| 11 | 3 | 2 | 3 | 5 | 1 | 10 | 0 | 20 |
| 10 | 2 | 2 | 2 | 5 | 0 | 10 | 0 | 21 |
| 9 | 1 | 2 | 1 | 5 | 1 | 11 | 0 | 22 |
| 8 | 0 | 2 | 0 | 5 | 0 | 11 | 0 | 23 |
| 7 | 7 | 3 | 3 | 6 | 1 | 12 | 0 | 24 |
| 6 | 6 | 3 | 2 | 6 | 0 | 12 | 0 | 25 |
| 5 | 5 | 3 | 1 | 6 | 1 | 13 | 0 | 26 |
| 4 | 4 | 3 | 0 | 6 | 0 | 13 | 0 | 27 |
| 3 | 3 | 3 | 3 | 7 | 1 | 14 | 0 | 28 |
| 2 | 2 | 3 | 2 | 7 | 0 | 14 | 0 | 29 |
| 1 | 1 | 3 | 1 | 7 | 1 | 15 | 0 | 30 |
| 0 | 0 | 3 | 0 | 7 | 0 | 15 | 0 | 31 |

For example, it is noted in TABLE 1, that bit number 20 of a 32-bit memory data word corresponds to (a) the 4th bit of pixel number 1 where there are 8 bits/pixel; (b) the 0th bit in pixel number 2 for 4 bits/pixel; (c) the 0th bit in pixel number 5 for 2 bits/pixel; or (d) the 0th pixel in pixel number 11 for 1 bit/pixel. In the fourth column of TABLE 1, it is observed that, for 1 bit/pixel, each bit B is always the 0th bit with each memory word bit number corresponding to a distinct pixel.

TABLE 2 shows which bit number outputs from the VRAMs make up successive pixel values in a 4 bit/pixel environment.

TABLE 2

| Sequence of 4 bit pixels in 8 bit pixel mode | |
|---|---|
| First pixel | Bits 27-24 |
| Second pixel | Bits 19-16 |
| Third pixel | Bits 11-8 |
| Fourth pixel | Bits 3-0 |

Referring to TABLE 2 and TABLE 1, it is noted that the sequence of bit numbers shown in TABLE 2 (i.e., 27,26,25,24,19,18 . . . ) corresponds to the sequence of pixels 1, 3, 5, 7 in TABLE 1. This is undesirable for two reasons. First, the memory not required when in the 4 bits/pixel mode—rather than the 8 bits/pixel mode—is not recoverable. The unused memory is arranged in alternate nibbles of the 32 bit word output of the VRAMs. A far more desirable solution would allow the unused half of the memory (a full 512 kilobytes) to be recovered for use as program/data storage or a second page of video. Second, because the pixels are stored in alternate nibbles, the display is more difficult to update for an application program. In this regard, the application program must account for the pixel spacing within the word. Similarly, if the apparatus of FIG. 1 is used for 8-bit pixels and 2-bit pixels, then the unused memory in the 2 bit/pixel mode, namely 768 kilobytes, appears as 6 bits of every byte. The wasted memory is quite substantial.

SUMMARY OF THE INVENTION

The present invention is directed to solving the above-mentioned problems of inefficiently using memory when pixel values vary in bit-length. That is, the present invention is directed to a display and memory system in which the number of bits/pixels is selectable and the memory required is adjustable based on the selected number of bits/pixel.

The above object is achieved by a serializer which takes $2^M$ outputs from the VRAMs and forms them into $2^{(M-n)}$ successive data groups where each data group has $2^n$ bits where n is variable and where n, M, N are integers ($1 \leqq n \leqq M$). The serializer enables M parallel VRAM outputs to be selectively organized to provide pixel values of variable bit-lengths by use of bit-gating.

For VRAMs which together provide 32 outputs, for example, the serializer may selectively and alternatively provide outputs of differing forms. For example, allocating 8 bits/pixel, the 32 outputs can be serialized to produce 4 8-bit values (one for each of four pixels); or allocating 4 bits/pixel, the 32 outputs can be serialized to produce 8 4-bit values (one for each of eight pixels); or allocating 2 bits/pixel, the 32 outputs can be serialized to produce 16 2-bit values; and so on. The alternative modes are achieved with bit-gating circuitry.

A first embodiment of the invention involves cascaded multiplexers which gate through selected inputs thereto. In this first embodiment, the outputs from some of the shift registers 120 through 134 enter multiplexers at a first level. Outputs from at least some of the first level of multiplexers enter multiplexers at a second level of multiplexers; outputs from at least some of the second level of multiplexers enter multiplexers at a third level of multiplexers; and so on in cascaded fashion. To maintain synchrony between multiplexed outputs and unmultiplexed outputs at the various levels, unmultiplexed outputs are latched.

A second embodiment involves a plurality of parallel $2^X$-to-1 selector multiplexers positioned in a descending order. The value of $2^X$ (where X is an integer) is determined by the number of selectable bits/pixel choices. Each input to a selector multiplexer corresponds to a distinct bits/pixel option. Hence, for a given bits/pixel choice, each selector multiplexer gates through a particular input thereof. The output of each selector multiplexer is one input to a respective 2-to-1 multiplexer. The other input to each 2-to-1 multiplexer corresponds to the output from the next higher-positioned 2-to-1 multiplexer. One or more of the 2-to-1 multiplexer outputs are selectably clocked out as video outputs. The selector multiplexers and the 2-to-1 multiplexers operate in concert—in a gating circuit—to enable successive 1-bit, 2-bit, 4-bit, . . . data groups to be outputted from one, two, four, . . . video outputs.

In accordance with the present invention, without adding undo logic, a serializer circuit allows multiple choices of bits/pixel while still allowing all unused memory to appear as a single contiguous block.

Moreover, according to the invention, the selection of bits/pixel can be made dynamically under software control.

Furthermore, wires connected to drive the display (or a lookup table) do not change definition depending on the number of bits/pixel to be associated with gray-levels or colors or other "planes" of resolution. That is, regardless of the number of bits/pixel, bit 0 is always available, in the proper sequence, on video line VIDEO0; bit 1 of a pixel is always available, in sequence, on video line VIDEO1; and so on. Accordingly, processing pixel information is relatively simple.

DESCRIPTION OF THE INVENTION

Figure 1:
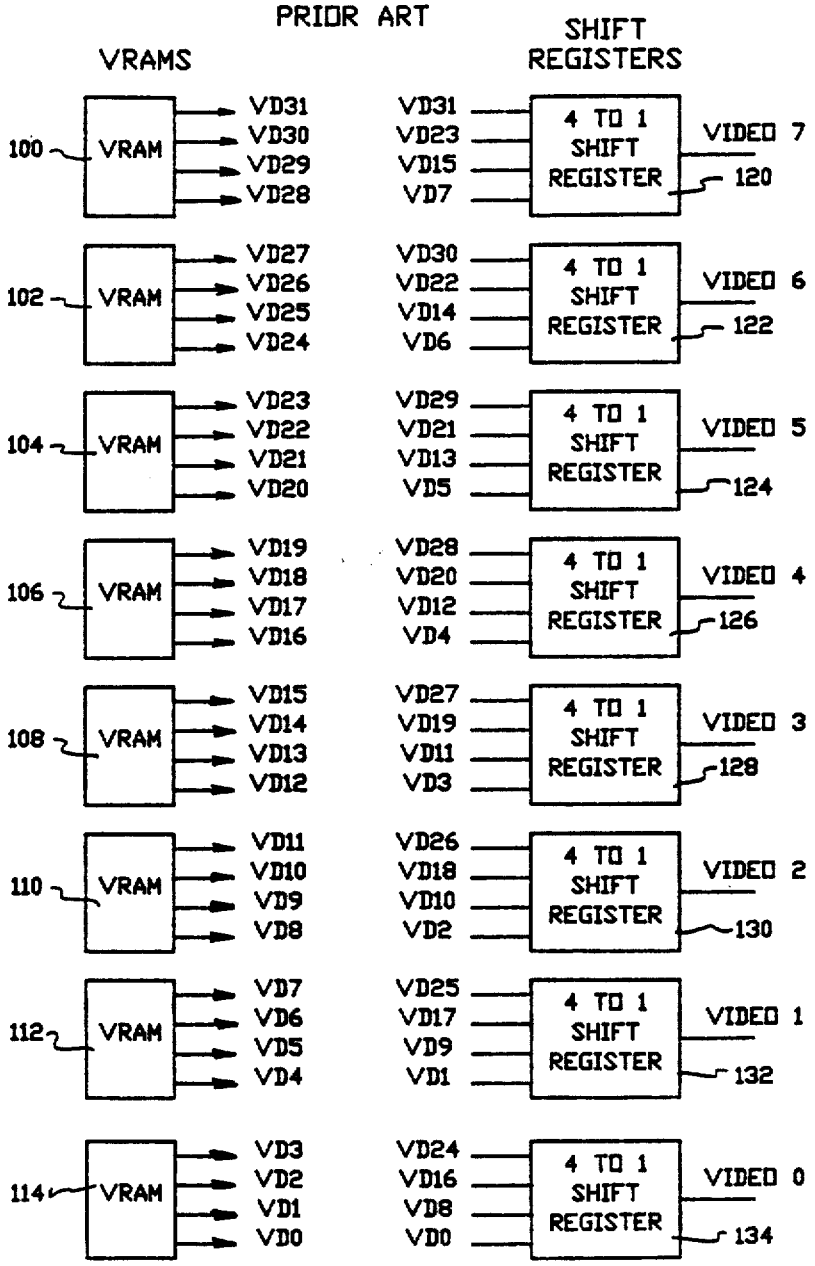
FIG.1 PRIOR ART
FIG. 1 is a diagram illustrating a prior art structure.
Figure 2:
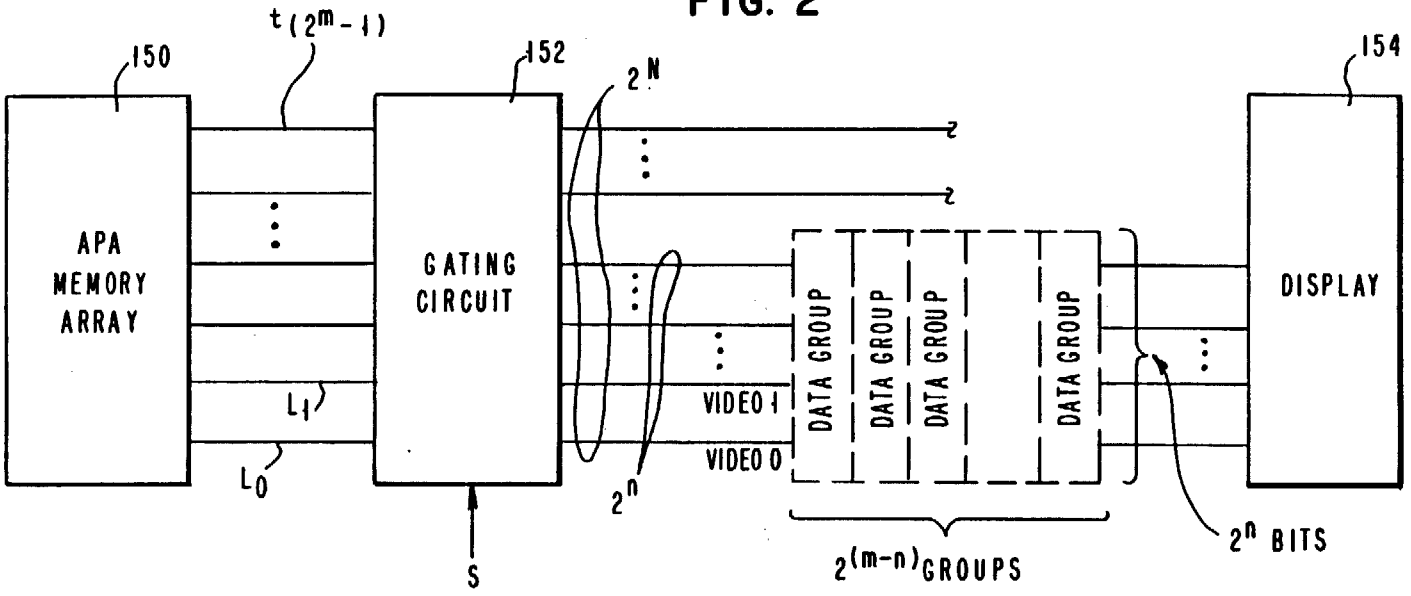
FIG. 2 is a general block diagram of the present invention.

Referring to FIG. 2, a general block diagram illustrating the present invention in a display environment is shown. An all points addressable (APA) memory 150 has $2^M$ output lines therefrom which are connected to a gating circuit 152. In some instances, the $2^M$ lines may be used to convey values for four pixels, in other instances eight pixels, . . . , and so on. To enable the conveyance of a variable number of pixel values (of differing bit-lengths) over the same number of lines exiting the APA memory array 150, the gating circuit 152 is provided.

The gating circuit 152 has $2^N$ possible output junctions. The gating circuit 152 receives an input signal S which depends on the number of bits each pixel is to be represented by or, alternatively, the number of pixels to be conveyed on the $2^M$ lines. Based on the input signal S, the gating circuit 152 passes through the data from the $2^M$ lines to form $2^{M-n}$ data groups which are communicated along $2^n$ of the $2^N$ junctions. If N=3, for example, the gating circuit 152 has 8 useable output junctions—which can be identified respectively as VIDEO0 through VIDEO7. For pixels which are to have either a black or white (binary) value, n=1. Assuming M=5, the gating circuit 152 will form the data on the 32 ($2^5$) lines into 32 data groups with each group having a bitlength of one. (A binary value is expressed with one bit.) Similarly, if each pixel were to be represented with 16 levels of gray there would be $2^n=4$ junctions and the data entering the gating circuit 152 on the 32 lines would be formed into $2^{(5-2)}=8$ data groups each having a bitlength of 4.

In operation, the gating circuit 152 performs preferably as follows to put out 8 data groups (where each data group represents a 4-bit pixel value) for each set of 32 parallel inputs to the gating circuit 152. The data bits conveyed along the 4 lowest order lines ($L_0$ through $L_3$) of the $2^M$ lines are first passed through the gating circuit 152 onto respective output junctions VIDEO0, VIDEO1, VIDEO2, and VIDEO3 as the first 4-bit pixel value. The first 4-bit pixel value is communicated via the output junctions to a display 154. The cathode ray beam of the display 154 has an intensity which is controlled by the 4-bit pixel value received thereby.

The data bits from the next four lowest order lines (namely, $L_4$ through $L_7$) are thereafter conveyed via junctions VIDEO0, VIDEO1, VIDEO2, VIDEO3 to the display 154. The pixel values entering the display 152 via the junctions VIDEO0 through VIDEO3 are in synchrony with the scanning of the cathode ray beam so that the conveyed pixel values match the pixel being illuminated by the beam.

Depending on the signal S, the gating circuit 152 can produce as outputs pixel values having a selectable number of bits/pixel. That is, by varying S, the value of $2^n$ is changed. $2^n$, it is noted, represents the number of bits/pixel. The number of bits/pixel can be any value $2^n$ where n=0, 1, 2, 3—namely 1, 2, 4, or 8—where n is limited to a value less than or equal to N (which equals 3 in the above example).

A. FIRST EMBODIMENT

Figure 3A:
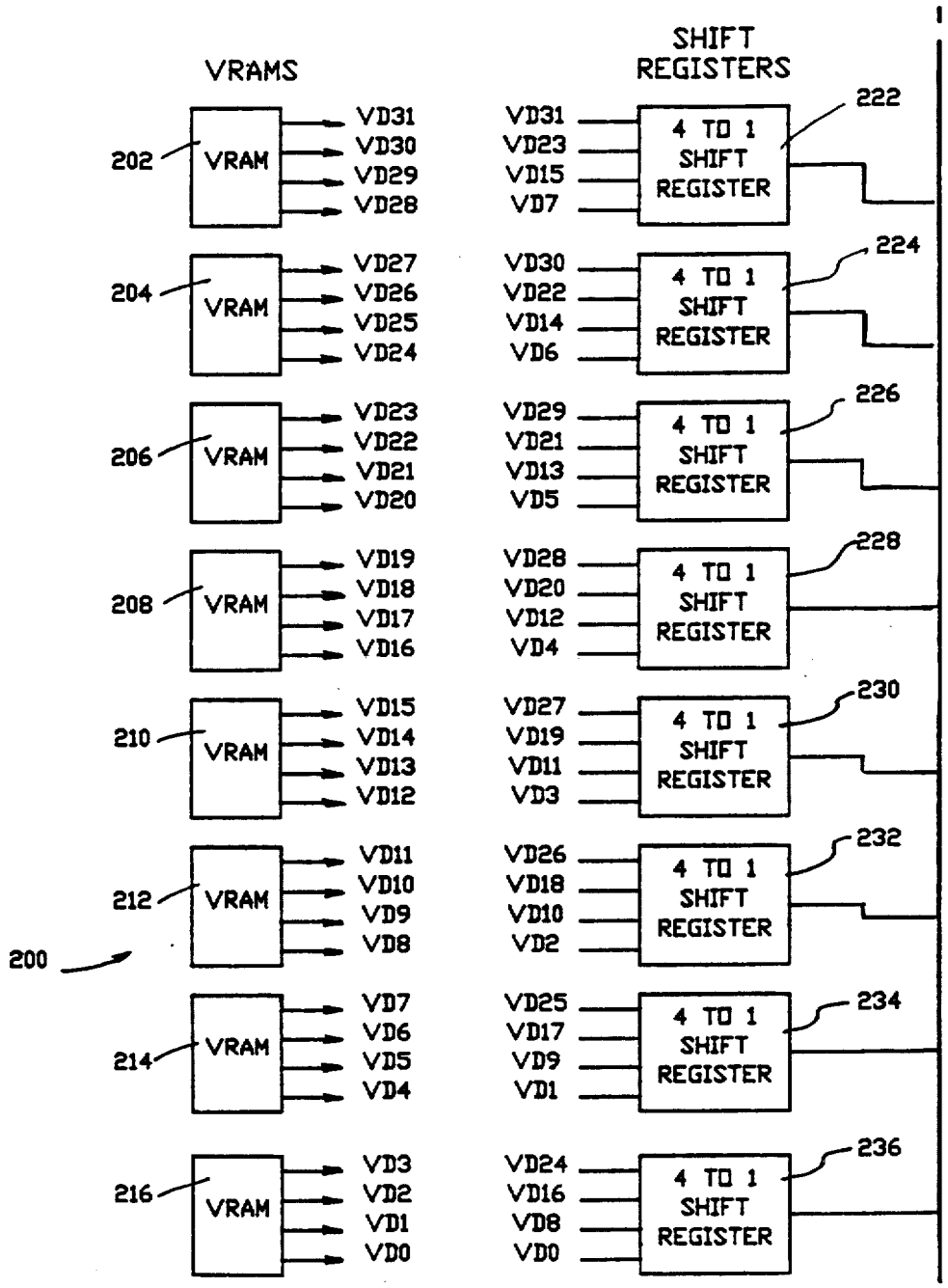
FIG. 3, which is comprised of FIGS. 3A and 3B, is a diagram showing a first embodiment of a bit-gating serializer according to the present invention.
Figure 3B:
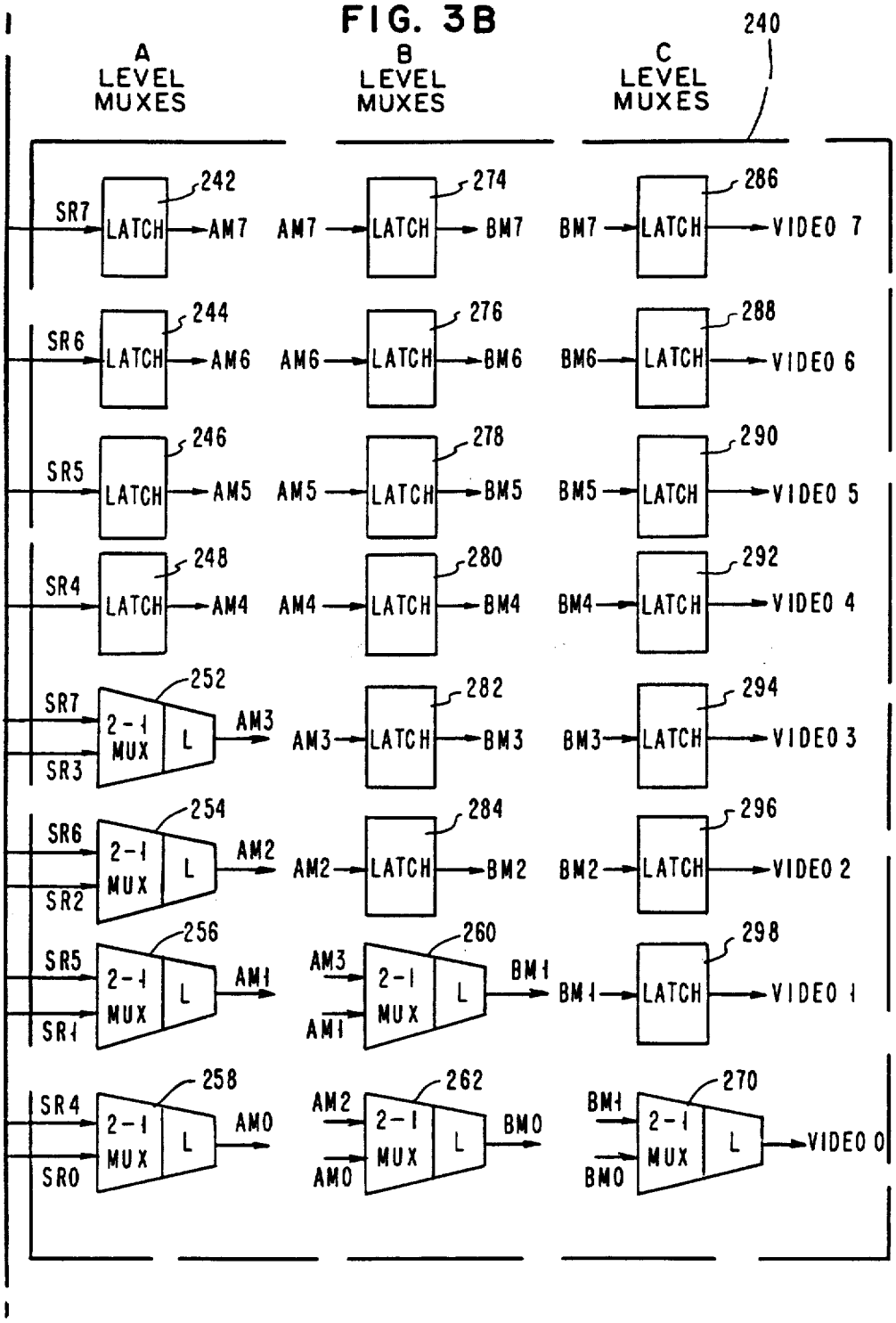

Referring to FIG. 3, a circuit 200 is shown which forms 32 memory outputs from memory into successive data groups wherein each data group corresponds to a color or gray level value for a corresponding pixel in an image. In FIG. 3, the 32 memory outputs are shown exiting eight VRAMs 202 through 216. The outputs of the VRAMs are labelled in a descending order as VD31 through VD0. Each VRAM 202 through 216 has four outputs. The outputs of the VRAMs serve as inputs to eight 4-to-1 shift registers 222 through 236. Each output from a VRAM enters only one shift register 222 through 236. The inputs to each shift registers 222 through 236 are selected to be of the form VD(i),VD(ik30 8),VD(i+16),VD(i+24) where i=0 for shift register 236, i=1 for shift register 234, i=2 for shift register 232, and so on. By way of example, it is observed that shift register 222 receives as inputs thereto the four VRAM outputs VD7,VD15,VD23,VD31. Each shift register 222 through 236 shifts out its respective inputs one after another in sequence and in synchrony with the shifted outputs of the other shift registers. Hence, on a first clock, the eight shift registers 222 through 236 together produce a first 8-bit output string along shift register output lines SR0 through SR7. The first 8-bit output string correspond to VD0 through VD7. On the second clock, lines SR0 through SR7 carry data from lines VD8 through VD15 as a next output string. On the next clock, the data on lines VD16 through VD23 are output as a third string on lines SR0 through SR7, respectively. With another clock, the data on lines VD24 through VD31 are output as a fourth string from lines SR0 through SR7.

As noted above, the structure of VRAMs 202 through 216 feeding shift registers 222 through 236 is conventional—permitting a 32-bit memory to produce a series of 8-bit values for successive pixels. For applications in which the pixels are limited to eight bits/pixel, the VRAM-shift register structure is adequate.

However, if the number of bits/pixel are to be varied, another arrangement of data is required.

The FIG. 3 arrangement involves a cascaded multiplexer arrangement 240. The arrangement 240 is shown having a first "A" level which includes four latches 242 through 248 and four latching multiplexers 252 through 258 each with a "built-in" latch. In this description, each multiplexer is a latching multiplexer unless otherwise indicated. Each of the four latches 242 through 248 delays a unique one of the four shift register outputs SR4 through SR7. Data on line SR7 enters latch 242; data on SR6 enters latch 244; data on SR5 enters latch 246; and data on SR4 enters latch 248. The four "A" level multiplexers 252 through 258 are 2-to-1 multiplexers which receive as inputs SR(i),SR(I+4) where i=0 for multiplexer 258; i=1 for multiplexer 256; i=2 for multiplexer 254; and i=3 for multiplexer 252. The respective outputs of multiplexers 158 through 252 are identified as AM0 through AM3 respectively and alternatively represent one of the two inputs thereto. The multiplexers 252 through 258 are all gated to pass through (a) either of two shift register outputs in multiplex fashion of (b) the output from only a single shift register. For example, multiplexer 252 either toggles between outputting data for SR3 or SR7 or, alternatively, always passes through data corresponding to SR3—depending—on the input signal to the "A" level multiplexers 252 through 258. Together the shift registers 222 through 236 and the cascaded multiplexer arrangement 240 comprise a gating circuit 259.

When the gating circuit 259 is to provide 8-bit outputs, the multiplexers 252 through 258 gate only the data on SR3 through SR0 respectively onto the AM3 through AM0 lines. The data on lines SR7 through SR4 are processed through the latches 242 through 248 respectively. The data on lines SR7 through SR0 are carried in synchrony on lines AM7 through AM0 respectively—the gating circuit 259 thereby producing, at the "A" level, successive words each being formed of 8 parallel bits. The "A" level does not affect the outputs from the shift registers 222 through 236 in this case.

When the gating circuit 259 is switched to enable multiplexers 252 through 258 to gate the shift register outputs in alternation, the "A" level latches 242 through 248 are not employed. Lines AM3 through AM0 carry, in alternating fashion, the data on lines SR3 through SR0 respectively and the data on lines SR7 through SR4 respectively. Instead of one 8-bit output, the "A" level produces two sequential 4-bit outputs on lines AM3 through AM0 for each set of eight parallel bits coming from the shift registers on SR7 through SR0.

Following the "A" multiplexer level are a "B" multiplexer level and a "C" multiplexer level. The "B" and "C" multiplexer levels operate similar to the "A" level, except that each subsequent level can be switched to produce alternating multiplexer outputs only if the earlier levels are. That is, the multiplexers 260 and 262 of the "B" level can pass through data from alternate multiplexer inputs only when multiplexers 252 through 258 are gated to toggle between inputs. Similarly, the "C" multiplexer 270 is limited so that it can toggle between the BM1 and BM0 lines—the output lines of the "B" level multiplexers 260 and 262 respectively—only when multiplexers 252 through 262 are gated to provide data from alternate input lines.

It is observed that, for an 8-bit output from the gating circuit 259, all multiplexers 252 through 270 are switched to pass through only the lower order input line. That is, the multiplexers 252 through 258 pass through only SR3 through SR0 as outputs AM3 through AM0. Four other bits are conveyed via latches 242 through 248 along lines AM7 through AM4. The data on lines AM7 through AM0 is processed at the "B" level by (a) passing only AM0 through multiplexer 262 onto line BM0; (b) passing only AM1 through multiplexer 260 onto line BM1; and (c) delaying data on lines AM2 through AM7 in "B" level latches 274 through 284 to provide respective data output on lines BM7 through BM2. At the "C" level, the data on line BM0 only passes through the multiplexer 270 onto line VIDEO0. Data on lines BM1 through BM7 are delayed by latches 286 through 298 to keep the latched output bits in synchrony with the data bits that are gated through multiplexer 270.

In the sample structure of FIG. 3, four resolutions are available: eight bits/pixel, four bits/pixel, two bits/pixel, and one bit/pixel. As the desired number of bits/pixel is decreased, the cascade of multiplexers 252 through 270 allows data that would have been wasted in prior art devices to be gated onto active video line(s) VIDEO0, . . . As previously noted, the latches ensure that the data remains in synchrony (i.e., all bits of a pixel stay coherent in time), and pixels will not be lost. As the number of bits/pixel is decreased, the unused memory appears as a contiguous block of memory, since the cascaded multiplexers 240 allows the pixels to be packed into the 32-bit word. Not only is memory conserved as the resolution drops, but no rewiring is necessary, VIDEO0 is the least significant video bit in all four modes; VIDEO1 is the second least significant bit in all but the lowest mode (in which event it is unused); and so on.

The clocks to the shift registers 222 through 236 are varied based on the desired pixel resolution (bits/pixel). The selector lines to the multiplexers 252 through 270 also depend on the desired resolution. The frequency of the control signals can be expressed as a fraction of the basic display dot clock, with 0 meaning the selector is kept at 0, as shown in TABLE 3.

TABLE 3

| | | Fraction of dot clock speed for 32-bit input | | | |
|---|---|---|---|---|---|
| PIXELS PER WORD | BITS PER PIXEL | SHIFT REGISTERS | MUXES ROW A | MUXES ROW B | MUX ROW C |
| 4 | 8 | 1 | 0 | 0 | 0 |
| 8 | 4 | ½ | ½ | 0 | 0 |
| 16 | 2 | ¼ | ¼ | ½ | 0 |
| 32 | 1 | ⅛ | ⅛ | ¼ | ½ |

For example, if 16 2-bit pixels are desired (see line 3 of TABLE 3), the fractions of the dot clock speed that are required can be easily calculated by working backwards. The C level multiplexers selector clock stays at 0, so as to pass VIDEO0 straight through. The B level multiplexers selector clock operates at half the dot clock so that new pixels are available every dot clock. The A level multiplexers selector clock operates at half the rate of the B level multiplexers or one quarter that of the dot clock, providing new pixels to the B multiplexers 260 and 262 every two pixels. The multiplexers select new information based on the selectors level. The shift registers 222 through 236 operate at half the rate of the A level multiplexers, but the shift clock is edge triggered, so it operates at the same rate as the A level multiplexers selector, or one quarter the dot clock rate.

In a minimal system for the first embodiment, eight 1 megabit VRAMs provide a full megabyte of system/video storage. Initially, the user could select (through software) a 4 bit/pixel system, leaving 512 kilobytes of system storage. If memory is added, then an 8-bit pixel display could be chosen. On occasions where still more system memory is needed, the user could select the 4 bit/pixel system in order to have an additional 512 kilobytes of system memory. The change between display modes could be made dynamically to balance between the desired level of displayable colors or gray levels and the desired amount of system memory.

In the first embodiment, the VRAM corresponds preferably to a commercially available NEC μPD422257 1048576 Bit Dual-Port Memory. The gating circuit 152 is preferably an LSI Logic LCA 10000 Series using the following macrocells: 4-to-1 multiplexers MUX41 (4-bit non-inverting multiplexer), 2-to-1 multiplexers MUX21H, (a non-inverting gate multiplexer), and flip-flop latches FD2 (a D type flip-flop with CLEAR). A four-to-one shift register (as shown in FIG. 3) is preferably a commercially available 74F195 (4-bit parallel access shift register). Other commercially available components may be readily substituted as desired.

B. SECOND EMBODIMENT

Figure 4:
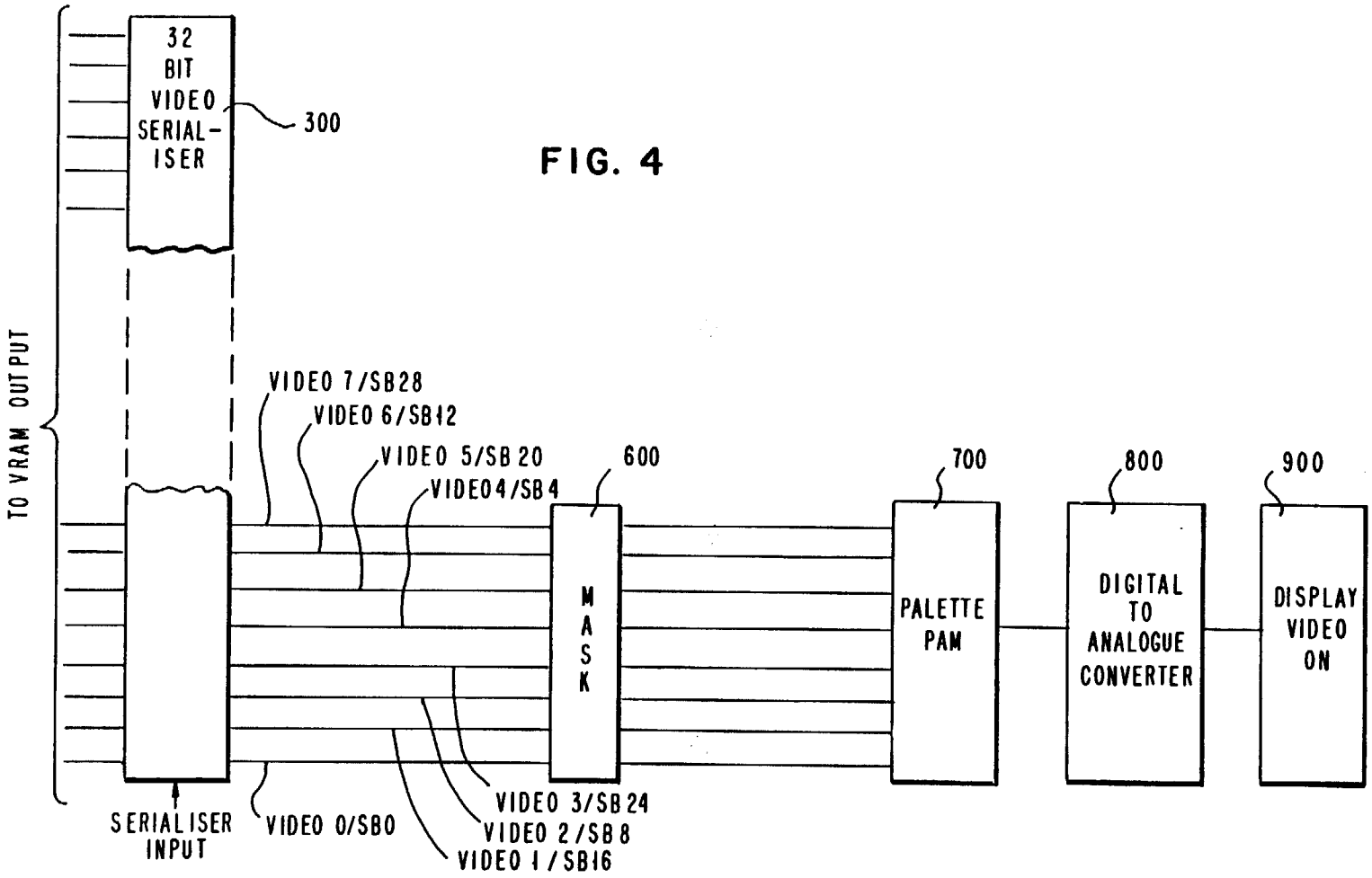
FIG. 4 is a block diagram of the present invention in a specific environment in which values derived from a memory are used in coloring pixels of an image.

FIG. 4 shows a specific environment in which a serializer 300 in accordance with the present invention may be used. The serializer 300 has 32 input junctions connected to receive 32 data outputs from an APA memory (not shown). The serilalizer 300 may be as described in the above cascaded multiplexer embodiment or, alternatively, may correspond to a second serializer embodiment 301 as illustrated in FIG. 5.

Figure 5:
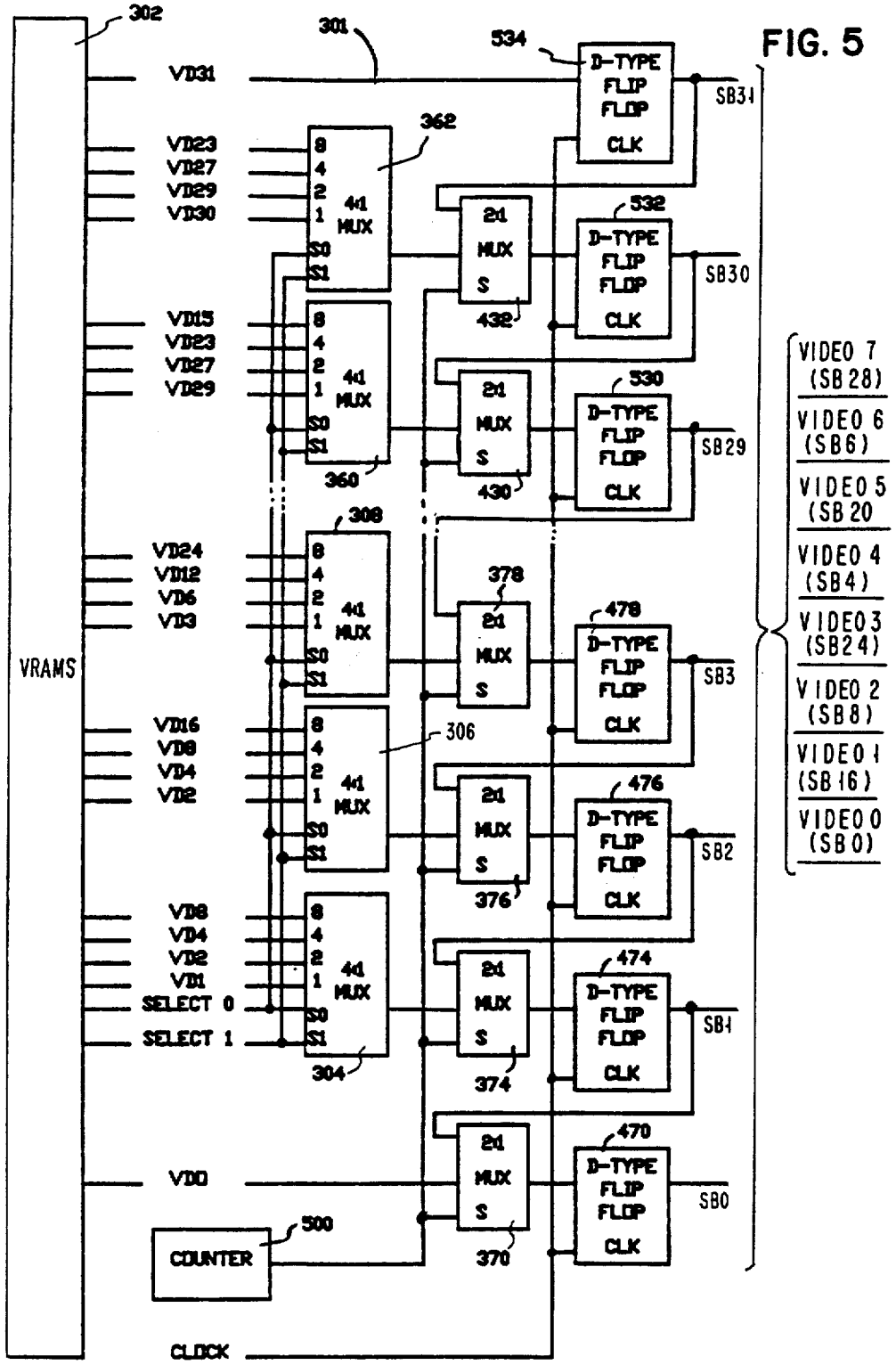
FIG. 5 is a diagram showing a second embodiment of a bit-gating serializer according to the present invention.

As in the first embodiment, VRAMs 302 provide thirty-two outputs which are identified as VDO through VD31 to serializer 301 of the FIG. 5 embodiment. The outputs VD1 through VD30 are combined to form thirty exclusive combinations each including four VD data bits. Each combination of VD data bits enters a respective 4-to-1 multiplexer 304 to 362 each having a "1", a "2", a "4", and an "8" input. Each 4-to-1 multiplexer 304 to 362 has an S0 input and an S1 input, each S0 input being connected to a common S0 L select line and each S1 input being connected to a common S1 select line. Depending on the binary values for S0 and S1, the 1, 2, 4, or 8 input to each multiplexer 304 to 362 is passed through. By way of example, (S1, S0) values of (0, 0) can result in all of the "1" inputs being passed so that multiplexer 304 passes through VD1; multiplexer 306 passes through VD2; multiplexer 308 passes through VD3; . . . ; multiplexer 360 passes through VD29; and multiplexer 362 passes through VD30. In the example, for (S1, S0) values of (0, 1), the "2" inputs would be passed through each multiplexer 304 through 362. That is, multiplexer 304 would pass through VD2; multiplexer 306 would pass through VD4; multiplexer 308 would pass through VD6; . . . ; multiplexer 360 would pass through VD27; and multiplexer 362 would pass through VD29. Similarly, for (S1, S0) values of (1, 0), multiplexer 304 would pass through VD4; multiplexer 306 would pass through VD8; multiplexer 308 would pass through VD12; . . . ; multiplexer 360 would pass through VD23; and multiplexer 362 would pass through VD27. Lastly, for (S1, S0) values of (1, 1), multiplexer 304 would pass through VD8; multiplexer 306 would pass through VD16; multiplexer 308 would pass through VD24; . . . ; multiplexer 360 would pass through VD15; and multiplexer 362 would pass through VD23.

The input foursome to each multiplexer 304 to 362 is set forth in TABLE 4.

TABLE 4

| | | | |
|---|---|---|---|
| 31 | 11 | 31 | 31 |
| 30 | 29 | 27 | 23 |
| 29 | 27 | 23 | 15 |
| 28 | 25 | 19 | 7 |
| 27 | 23 | 15 | 27 |
| 26 | 21 | 11 | 19 |

TABLE 4-continued

| | | | |
|---|---|---|---|
| 25 | 19 | 7 | 11 |
| 24 | 17 | 3 | 3 |
| 23 | 15 | 29 | 29 |
| 22 | 13 | 25 | 21 |
| 21 | 11 | 21 | 13 |
| 20 | 9 | 17 | 5 |
| 19 | 7 | 13 | 25 |
| 18 | 5 | 9 | 17 |
| 17 | 3 | 5 | 9 |
| 16 | 1 | 1 | 1 |
| 15 | 30 | 30 | 30 |
| 14 | 28 | 26 | 22 |
| 13 | 26 | 22 | 14 |
| 12 | 24 | 18 | 6 |
| 11 | 22 | 14 | 26 |
| 10 | 20 | 10 | 18 |
| 9 | 18 | 6 | 10 |
| 8 | 16 | 2 | 2 |
| 7 | 14 | 28 | 28 |
| 6 | 12 | 24 | 20 |
| 5 | 10 | 20 | 12 |
| 4 | 8 | 16 | 4 |
| 3 | 6 | 12 | 24 |
| 2 | 4 | 8 | 16 |
| 1 | 2 | 4 | 8 |
| 1 | 0 | 0 | 0 |

In TABLE 4, the rows between the bottom row of the table and the top row of the table are associated with respective 4-to-1 multiplexers in FIG. 5. Starting at the second row from the top, it is observed that the numbers in the four columns—namely 30, 29, 27, 23—correspond to the foursome of VD outputs which enter the multiplexer 362. The third row from the top includes the numbers 29, 27, 23, 15 which correspond to the VD29,VD27,VD23,VD15 outputs which enter the multiplexer 360. In like fashion, the four inputs to multiplexer 358 (not specifically shown in FIG. 5) are VD28,VD25,VD19,VD7 corresponding to the entries in the third line from the top of TABLE 4.

The values (S1, S0) are particularly significant in that they indicate the number of bits/pixel. A (0, 0) input on lines S1 and S0 correspond to 1 bit/pixel; (0, 1) corresponds to 2 bits/pixel; (1, 0) corresponds to 4 bits/pixel; and (1, 1) corresponds to 8 bits/pixel. By changing the values of S1 and S0, then, the number of bits allocated to each pixel may be varied as desired.

In this regard, when S1 and S0 are both 0, the multiplexers 304 through 362 pass through the "1" inputs thereto so that data bits corresponding to outputs VD1 through VD30—as identified in the first column of the TABLE 4 table—are the respective multiplexer outputs. Similarly, when S1=0 and S0=1, the VD outputs corresponding to the numbers indicated in column two of TABLE 4 are passed through the 30 multiplexers 304 to 362. The remaining two columns similarly identify the outputs generated when (S1, S0) are (1, 0) and (1, 1) respectively.

The VDO line is connected to an input to a 2-to-1 multiplexer 370. In addition, the output of each 4-to-1 multiplexer 304 to 362 serves as an input to a respective 2-to-1 multiplexer 374 to 432. Each 2-to-1 multiplexer 370 though 432 has an output connected to the input terminal of a D-type flip-flop 470 through 532 respectively. Line VD31 is also connected to a D-type flip-flop 534. Each flip-flop 470 through 534 has a clock input terminal CLK. All of the CLK terminals are connected to a common clock (not shown). The outputs from the D-type flip-flops 470 through 534 enter serialzer bit output junctions SB0 through SB31. It is noted that each serializer bit output junction is connected to one of the two inputs to the 2-to-1 multiplexer at the next lower-order position. For example, SB31 is connected as one of the two inputs to the 2-to-1 multiplexer 532, the other input corresponding to the output from multiplexer 362. Similarly, SB30 is connected as one of the two inputs to the 2-to-1 multiplexer430, the other input corresponding to the output from multiplexer 360; and so on.

Each 2-to-1 multiplexer 370 through 432 receives as input a common load serializer signal S. Depending on the value for S, either (a) the output from a corresponding 4-to-1 multiplexer or (b) a next-higher order serializer bit (SB) is passed through to a corresponding D-type flip-flop.

The video output lines of the serializer 301 extend from selected serializer bit output junctions SB0 through SB31. In particular, the first output line VIDEO0 extends from SB0; the second output line VIDEO1 extends from SB16; the third output line VIDEO2 extends from SB8; the fourth output line VIDEO3 extends from SB24; the fifth output line VIDEO4 extends from SB4; the sixth output line VIDEO5 extends from SB20; the seventh output line VIDEO6 extends from SB6; and the eight output line VIDEO7 extends from SB28. The eight outputs VIDEO0 through VIDEO7 correspond to the similarly labelled outputs in the first embodiment.

That is, successive 8-bit values can be conveyed through video output lines VIDEO0 through VIDEO7; successive 4-bit values can be conveyed through lines VIDEO0 through VIDEO3; successive 2-bit values can be conveyed through lines VIDEO0: and VIDEO1; and successive 1-bit values can be conveyed through line VIDEO0.

As suggested above, the manner in which the data on memory output lines VD0 through VD31 are outputted through the video output lines VIDEO0 thrugh VIDEO7 is determined by the signals entering the S, S1, and S0 terminals of the multiplexers.

By way of example, suppose S1=0 and S0=0 resulting in the "1" input to each 4-to-1 multiplexer 304 through 362 being passed through. That is, data corresponding to VD1 through VD30 are passed through the 4-to -1 multiplexers 304 to 362 and serve as one input to respective 2-to-1 multiplexers 374 to 432. Assume that initially the S input to each 2-to-1 multiplexer 374 to 432 is set to 0, in which event each 4-to-1 multiplexer output is passed through the 2-to-1 multiplexer connected thereto. A clock pulse to the D-type flip-flops 470 to 534 causes data from the 4-to-1 multiplexers—which has been gated through the 2-to-1 multiplexers 370 through 432—to be entered onto serializer bit outputs SB0 through SB31.

If S is then set to 1 and each D-type flip-flop 470 through 534 is clocked at it CLK input, each serializer bit output moves downward to the next lowest order serializer bit output via the 2-to-1 multiplexer and flip-flop of the same order. It is observed that if S is set at 0 and the flip-flops are clocked 32 times, the data from lines VD0 through VD31 are successively serially outputted through the video output line VIDEO0. This corresponds to 32 (black/white) 1-bit pixel values being outputted by the serializer 301.

For 2-bit values, the serializer 301 operates as follows. The 2-bit values are to be outputted through the video output lines VIDEO0 and VIDEO1—which correspond to SB0 and SB16, respectively. Referring to TABLE 4, it is observed that for two bits/pixel, the second column from the left applies. In such case, S1=0and S0=1. With these signal inuts, TABLE 4 indicates that the 4-to-1 multiplexers 374 through 402 output the even VD values in ascending order whereas multiplexers 404 through 432 output the odd VD values in ascending order. When S=0 and the flip-flops 470 through 534 are clocked once, the even VD values—VD0, VD2, VD4, . . . , VD30—are entered onto the serializer bit outputs SB0 through SB15 respectively. At the same time, the odd VD values —VD1, VD3, VD5, . . . , VD31—are entered onto the serializer bit outputs SB16 through SB31 respectively. It is observed that VD0 and VD1 are initially at the serializer bit outputs SB0 and SB16 (i.e., VIDEO0 and VIDEO1) respectively. VD0 in parallel with VD1 are outputted from VIDEO0 and VIDEO1 together as the first 2-bit value. For the next fifteen clock pulses, S is set to 1. With each clock pulse, the data for each serializer output bit SB1 through SB15 descends until it reaches SB0 (i.e., VIDEO0) whereat the data is outputted. Similarly, the data for each serializer output bit SB17 through SB31 descends until it reaches SB16 (i.e., VIDEO1) whereat it is outputted. Hence, on the second clock pulse, VD2 is at the VIDEO0 video output line, and VD3 is at the VIDEO1 video output line. On the third clock pulse, VD4 is at VIDEO0 and VD5 is at VIDEO1; and so on. Eventually 16 2-bit values exit video output lines VIDEO0 and VIDEO1. For 4-bits/pixel, S1=1 and S0=0. The same type of process as discussed for the 2-bit case applies to the 4-bit case. Similarly, for 8 bits/-pixel, the process is also analogous except that S1=1 and S0=1. Reviewing the four columns in TABLE 4, it is observed that each column has a respective pattern. In the leftmost column, successive VD values are grouped with adjacent values in each group being separated by an increment of 1. In the 2 bit/pixel mode, adjacent VD values in each group are separated by an increment of 2. In the 4 bit/pixel mode, successive VD values are separated by an increment of 4. In the 8 bit/pixel mode, adjacent entries in each group are separated by an increment of 8.

Referring still to FIG. 5, it is observed that the S input to the 2-to-1 multiplexers 370 to 432 is provided preferably by a 5-bit programmable counter 550. The counter 550 permits a toggling of the 2-to-1 multiplexers 370 through 432 after a count of 2, 4, 8, 16, or 32 selectively.

Referring again to FIG. 4, the eight outputs of the serializer 300—VIDEO0 through VIDEO7—are shown as inputs to a mask 600. In effect, the mask 600 is used to disable address lines which are not required. When each pixel is represented by a 1-bit value, address bits 1 through 7 are not required. When each pixel is represented by a 2-bit value, address bits 2 through 7 are not required. Similarly, when each pixel is represented by a 4 -bit value, address bits 4 through 7 are not required. The address word from the mask 600 enters a palette RAM 700 which associates each address word with a corresponding color. A digital signal corresponding to the addressed color is outputted from the RAM 700 and enters a digital-to-analog (D/A) converter 800. The analog signal is carried to the display 900 at which the appropriate color for a scanned pixel is provided. Various commercial palette RAMs, masks and D/A converters may be used in practicing the FIG. 4 embodiment.

It should be noted that the video output lines VIDEO0 through VIDEO7 may also be used in a noncolor environment. In such an application, the video outputs could be masked as appropriate and the resultant values applied to control beam intensity at a given scanned pixel.

While the invention has been described with reference to preferred embodiments thereof, it will be understood by those skilled in the art that various changes in form and details may be made without departing from the scope of the invention. For example, in the first embodiment multiplexer levels may be added or deleted as desired or needed. For example, for a 64 bit input to the gating circuit which can produce outputs for up to 16-bit pixels, four multiplexer levels can be provided: the first would include eight 2-to-1 multiplexers; the second would include four 2-to-1 multiplexers; the third would include two 2-to-1 multiplexers; and the fourth would include a single 2-to-1 multiplexer. The outputs of two multiplexers at the first level serve as inputs to a multiplexer in the second level (as in the FIG. 3 embodiment); the outputs of two multiplexers at the second level serve as inputs to a multiplexer in the third level; and so on. Latches maintain synchrony and clocking is an extension of the clocking discussed hereinabove relative to FIG. 3. In general, each lth level will include $2^{N-l}$ latching multiplexers and $2^N-2^{N-l}$ latches. Given this general expression, it is observed that the outputs from shift registers $SR(2^{N/2})$ through $SR(2^N-1)$ enter respective latches and each also serves as an input to a respective 2-to-1 multiplexer at the first level. The other input to each 2-to-1 multiplexer is one of the outputs from SR(0) through through $SR(2^{N/2}-1)$ . In a more general case for the first respective latch at each successive level. Also in the more general case, where each multiplexer in a given level is identified as M(k) where k corresponds to the relative multiplexer position in the given level, the output of each multiplexer $$M\left(\frac{2^N}{2^{l+1}}\right)\text{through } M\left(\frac{2^N}{2^l}-1\right)$$

of a level (L—1) is delayed by a respective latch at a subsequent level L where L is any level up to the last level of multiplexers; some of these outputs also serving as inputs to multiplexers at the next level. The first "cascaded multiplexer" embodiment may be implemented for numerous levels of multiplexers and for various members of memory output bits (VD); the first embodiment operates in a similar manner whether there are 2, 3, or more multiplexer levels or whether there are 32 outputs (VD0 through VD31) or some other number of outputs from the memory. It should be further noted that, although the first embodiment shows multiplexers adjacent to higher ordered multiplexers, the multiplexers may be physically positioned otherwise while still operating in an equivalent manner. Also, regarding the first embodiment, each latching multiplexer—which is preferably a TTL element—may alternatively comprise a standard multiplexer followed by a latch.

The second embodiment may also be adapted to process data from an APA memory where the number of outputs varies from 32. In this regard, depending on the number of bits/pixel options desired, the 4-to-1 multiplexers may be replaced by $2^X$-to-1 multiplexers (where X is an integer). If X=3, there would be 8-to-1 multiplexers—each having S0, , S1, and S2 signal input. At X=3, there would be eight possible bits/pixel options. Other modifications and alterations may also be implemented in accordance with the invention as described in the following claims.

We claim as our invention:

1. Apparatus for serializing $2^M$ parallel outputs of an all points addressable memory into successive data groups, each data group corresponding to a respective value for a pixel in an image wherein the bit-length of the pixel value is selectable, the apparatus comprising:

gate means, having (i) $2^M$ parallel input junctions connected to the outputs of the memory and (ii) $2^N$ output junctions, for selectively converting each set of $2^M$ parallel inputs at said input junctions into $2^{M-n}$ successive data groups, each data group having a bit-length of $2^n$ data bits, wherein each data group exits the gate means through $2^n$ of the $2^N$ output junctions, with said gate means including shift register means for receiving as input from the memory successive sets of $2^M$ parallel bits and for shifting out, for each received input set, $2^{M-N}$ successive strings of $2^N$ bits, and multiplexers cascaded over successive levels, wherein each multiplexer in a first level receives as input selected bits of each shifted out string, and wherein each multiplexer in a subsequent level has as input outputs produced by prescribed multiplexers in the preceding level; and means for communicating to said gate means a signal input which controls the bit-length $2^n$ of data groups, wherein n is a selectable integer $1 \leqq n \leqq N \leqq M$.

2. The apparatus of claim 1 wherein said cascaded multiplexers include $2^{N-l}$ multiplexers in the lth level, where $1 \leqq l$.

3. The apparatus of claim 1 wherein said shift register means includes $2^N$ shift registers, each having a respective output SR(0) through $SR(2^N-1)$; and wherein said gate means further includes:

a plurality of bit-gate levels wherein each lth level includes $2^{N-l}$ 2-to-1 latching multiplexers and $2^N-2^{N-l}$ latches;

wherein each 2-to-1 multiplexer at a first level l=1 selectively puts out the bit value corresponding to either output SR(i) or $SR(i+2^{N-1})$ for a respective value of i where i is a value $0 \leqq i \leqq (2^N-1)$;

wherein each 2-to-1 multiplexer at a level $l \leqq 1$ selectively puts out the bit value corresponding to either M(j) or $$M\left(j+\frac{2^{N-1}}{2^l}\right)\text{for each } j \text{ where } 0 \leqq j \leqq \left[\frac{2^{N-1}}{2^l}-1\right]$$

and where M(k) corresponds to the output of the kth multiplexer in the preceding level; and wherein in the first level the output of each shift register $SR(2^{N/2})$ through SR $(2^N-1)$ enters a respective latch to provide an output in synchrony with the outputs from the first level multiplexers;

wherein the output of each latch at a level (L−1) is delayed by a respective latch at level L (where L≦total number of levels) and wherein each multiplexer output $$M\left(\frac{2^N}{2^{l+1}}\right)\text{through } M\left(\frac{2^N}{2^l}-1\right)$$

of a level (L−1) is delayed by a respective latch at a subsequent level L; the final level having only a single 2-to-1 multiplexer and ($2^N-1$) latches, the outputs from the final level multiplexer and final level latches being in synchrony.

4. Apparatus for serializing $2^M$ parallel outputs of an all points addressable memory into successive data groups, each data group corresponding to a respective value for a pixel in an image wherein the bit-length of the pixel value is selectable, the apparatus comprising:

gate means, having (i) $2^M$ parallel input junctions connected to the outputs of the memory and (ii) $2^N$ output junctions, for selectively converting each set of $2^M$ parallel inputs at said input junctions into $2^{M-n}$ successive data groups, each data group having a bit-length of $2^n$ of the $2^N$ output junctions, wherein said gate means includes:

a plurality of $2^{M-X}$ parallel $2^X$-to-1 multiplexers positioned in a prescribed order, each having a set of $2^X$ unique VD outputs as respective inputs thereto;

means for selecting the qth input to each $2^X$-to-1 multiplexer as the output therefrom, where q is an integer $1 \leqq q \leqq 2^X$;

a plurality of 2-to-1 multiplexers, each receiving as the first input thereto the output from a respective $2^X$-to-1 multiplexer; and means for clocking data through the 2-to-1 multiplexers as parallel data bits in response to a clock pulse, the data bit from each 2-to-1 multiplexer being conveyed to a respective output junction SB(i) wherein the data bit at output junction SB(i) represents the second input to the 2-to-1 multiplexer associated with the lower-ordered output junction SB(i-1) where i is an integer greater than 0;

wherein said signal input communicating means includes:

means for selecting either the first input or the second input for all of the 2-to-1 multiplexers; and means for selecting predetermined output junctions as video outputs wherein the selection of output junctions depends on the number of bits to be allocated to each pixel; and means for communicating to said gate means a signal input which controls the bit-length $2^n$ of data groups, wherein n is a selectable integer $1 \leqq n \leqq N \leqq M$.

5. The apparatus of claim 4 wherein, in response to a clock pulse by said clocking means when the first inputs to said 2-to-1 multiplexers have been selected, data bits from the $2^x$-to-1 multiplexers are conveyed onto output junctions SB(0) through SB ($2^x-1$); and wherein, in response to a clock pulse by said clocking means when the second inputs to said 2-to-1 multiplexers have been selected, the data bit at each output junction SB(i) is conveyed to a successively lower ordered output junction SB(i−1);

wherein said clocking means includes means for clocking bits to successively lower ordered output junctions for no more than $2^{M-n}$ clock pulses.

6. The apparatus of claim 5 wherein, for $2^n$ bits/pixel, $2^n$ output junctions are selected to receive data bits from $2^{M-n}$ unique output junctions in sequence in response to successive clock pulses from said clocking means; and wherein the inputs to the $2^x$-to-1 multiplexers correspond tothe VD outputs rearranged so that, for each of a plurality of $2^n$ values, the data bits at the video output lines at each clock pulse correspond to a $2^n$-bit pixel value formed of consecutive VD output bits.

7. The apparatus of claim 6 wherein said gating means further includes $2^n$ video output lines extending from respective selected output junctions, wherein successive data groups are conveyed along the $2^n$ video output lines in response to successive clock pulses from said clocking means; and wherein the $2^x$-to-1 multiplexers comprise sets of multiplexers each multiplexer set having $2^{M-n}$ $2^x$-to-1 multiplexers; and wherein successive $2^k$th inputs for successive multiplexers in a set correspond to VD outputs spaced every $2^k$ VD outputs.

8. Apparatus for displaying image data comprising:

video display;

means for serializing parallel outputs VD(0) through VD($2^M$) (where M is an integer) of an all points addressable memory into successive data groups, each data group corresponding to a respective value for a pixel in an image wherein the bit-length of the pixel value is selectable, the serializing means comprising:

gate means, having (i) $2^M$ parallel input junctions connected to the outputs of the memory and (ii) $2^N$ output junctions, for selectively converting each set of $2^M$ parallel inputs at said input junctions into $2^{M-n}$ successive data groups, each data group having a bit-length of $2^n$ data bits, wherein each data group exits the gate means through $2^n$ of the $2^N$ output junctions; and means for communicating to said gate means a signal which controls the bit-length $2^n$ of data groups, wherein n is a selectable integer $1 \leqq n \leqq N \leqq M$; and control means for generating a pixel value signal for each data group exiting the gate means and entering the pixel value signals to the display in sequence, wherein said control means includes:

palette memory means for associating each input address thereto with a color indicative value;

address means for converting data group inputs into address inputs to said palette memory means; and masking means for selectively entering, as address means input, only data group data on the $2^n$ of the $2^N$ output junctions.

* * * * *